US005139163A

United States Patent [19]

Diaz

[11] Patent Number: 5,139,163

[45] Date of Patent: Aug. 18, 1992

[54] HYGIENIC SEAL AND COVER FOR FOOD AND DRINK CONTAINERS

[76] Inventor: Eusebio M. Diaz, 6450 Balboa Blvd., Van Nuys, Calif. 91406

[21] Appl. No.: 799,974

[22] Filed: Nov. 29, 1991

[51] Int. Cl.[5] ..... B65D 51/22

[52] U.S. Cl. ..... 220/258; 220/259; 206/509

[58] Field of Search ..... 220/256, 257, 258, 259, 220/276, 380, 729

[56] References Cited

U.S. PATENT DOCUMENTS

| | | | |
|---|---|---|---|
| 3,135,418 | 6/1964 | Tracy | 220/258 X |
| 3,204,805 | 9/1965 | May | 220/258 X |
| 3,419,181 | 12/1968 | Stec | 220/258 |
| 4,162,023 | 7/1979 | Faltermeier | 220/258 |
| 4,494,672 | 1/1985 | Pearson | 220/263 |
| 4,609,123 | 9/1986 | Poncy | 220/258 |
| 4,708,257 | 11/1987 | Deline | 220/257 |
| 4,749,100 | 6/1988 | Eberhart | 220/306 |
| 4,815,628 | 3/1989 | Wehnert, III | 220/352 |
| 4,934,556 | 6/1990 | Kleissendorf | 220/269 |
| 4,951,836 | 8/1990 | Yoshimura et al. | 220/271 |

*Primary Examiner*—Stephen Marcus
*Assistant Examiner*—Nova Stucker
*Attorney, Agent, or Firm*—Albert O. Cota

[57] ABSTRACT

A reclosable cover for a beverage can (26) which has a cover body (20) with a lid (22) on top and sidewalls (24) on the periphery. The cover fits over the can and a tear strip (28) allows separation such that the lid may be parted from the body. A portion of the sidewall remains forming a hinge (34) permitting the lid to pivot from the can and yet stay in alignment for resealing by pressing on the lid interfacing an inner lip (36) that is integrally formed in the lid onto the can top. The body is permanently attached to the can at the lower periphery of the sidewalls. Optionally, a stacking groove (40) is formed into the lid in a mirror image of the bottom of the can permitting the cans to be stacked on top of each other for ease of storage.

10 Claims, 1 Drawing Sheet

HYGIENIC SEAL AND COVER FOR FOOD AND DRINK CONTAINERS

TECHNICAL FIELD

The present invention relates to beverage and food containers in general. More specifically to a hygienically sterile cover that protects the container and hinges open when a strip is removed exposing the top also permitting reclosure.

BACKGROUND ART

Previously, many types of covers, caps or lids have been in use in endeavoring to provide an effective means to protect the top of a beverage container prior to usage. These devices apparently have not proven popular due to their expense and complexity. Many approaches have been tried from dipping the container in a plastic material to adding a cover that is completely removed when prepared for use. Others have attempted to solve the problem by adding double tops, pivotal covers and also insulated jackets.

A search of the prior art did not disclose any patents that read directly on the claims of the instant invention however, the following U.S. patents were considered related:

| U.S. Pat. No. | INVENTOR | ISSUED |
|---|---|---|
| 4,609,123 | Poncy | 2 September 1986 |
| 4,494,672 | Pearson | 22 January 1985 |
| 4,271,972 | Thor | 9 June 1981 |
| 3,905,511 | Groendal | 16 September 1975 |
| 3,204,805 | May | 7 September 1965 |
| 2,582,360 | Sheridan | 15 January 1952 |

Poncy in U.S. Pat. No. 4,609,123 teaches a beverage can that includes a reclosable lid that has a top disk and a bottom disk both attached to the side walls of the can. An aperture is in the bottom disk and a stopper in the top with a tear strip on the top to form a closure when opened. A pull ring attached to the flap allows opening uncovering the aperture and the flap may then be replaced for closure.

U.S. Pat. No. 4,494,672 issued to Pearson teaches a pivotal mounted closure to a can. The closure is opened by manually depressing a lever positioned under a deflection plate attaching the closure to the can with a collar surrounding the can. The closure functions much like a mug lid.

A tamperproof overcap is disclosed in Thor's U.S. Pat. No. 4,271,972 that is molded of plastic and is installed over a container that has a plug for the primary enclosure. The overcap is snapped and locked onto the neck of the container and cannot be removed without destroying the integrity of the closure.

Groendal's U.S. Pat. No. 3,905,511 is for an insulated jacket allowing use without removal. The jacket has a closed top and a hinge opposite an opening in line with the can opening tab. The jacket is insulated and tightly fits over the beverage container.

U.S. Pat. No. 3,204,805 issued to May discloses a stripable coating on the upper surface of a drinking container that protects the upper surface of the container until used. The coating is removed using a tab, tear strip or simply peeling off with one's fingernail.

In U.S. Pat. No. 2,582,360 issued to Sheridan a container is disclosed for face powder having a movable window for exposing a selected amount of area to allow application by a puff without spilling or wasting the powder.

It will be noted that while prior art has attempted to cover the top of a beverage container by coating, adding detachable covers, or double tops, the invention even in its simplest form was not found.

DISCLOSURE DOCUMENT DEPOSIT

The disclosed invention is covered in Disclosure Document Deposit No. 28,593 dated Jun. 27, 1991.

DISCLOSURE OF THE INVENTION

The need has existed a long time for a device that protects the top of a beverage can from contamination. In many cases, the cans are stored either individually in open boxes or stacked in so called six packs where the top is exposed to dust and dirt which becomes the nutrient for pathogenic microorganisms including fungicidal spores. Further rodents may leave droppings on the cans and insects may be present where the cans are stored, all of which may be detrimental to the ultimate user's health. It is therefore a primary object of the invention to preclude this possible taint by enclosing the entire top of the can with a cover that stays with the beverage can from the time of manufacture where sanitary conditions may be controlled until the contents are consumed by the end user. This cover is thin enough to not take valuable space during storage and transportation and assures sanitation by the visual appearance of the unopened protective cover itself.

An important object of the invention allows the beverage to be resealed somewhat prolonging the freshness of the contents. While carbonation is partially lost when the reseal on the beverage can is broken, some residual carbonation will be maintained if the opening is sealed within a reasonable period of time. The invention includes an inner lip integral with the cover lid that grips the formed top of the can allowing the cover to be snapped in place on the top for resealing. This resealing permits longer storage such as in a refrigerator and also prevent spills on fragile surfaces that absorb liquids and stain such as rugs, tablecloths, sofas and the like. Additionally, the invention provides a container seal that prevents crawling and/or flying bugs from being attached to and possibly entering the open container; particularly, when the container contents is being consumed outdoors.

Another object of the invention is directed to the ability to stack the beverage cans one on top of the other. This capability is afforded in both single cans and in six packs where the cans are connected together on the top. It is easily seen that this feature enhances the utility of the beverage can in this area as most cans by themselve do not have this ability due to the constraints of manufacture.

Still another object of the invention is the ease in which it is used. The use of a pull strip with a tab is intuitively obvious to the user by simply lifting the tab with one's fingernail and pulling around until the strip is removed or in another embodiment, partially removing the strip to eliminate the problem of waste disposal and littering. In any event, the function is easy and natural and takes only a small amount of effort and time and the purpose of the cover is evident to the user.

Yet another object of the invention is the cost effectiveness of the invention. Once the tooling has been acquired, the amount of material is minimal and the ease of application with automatic snacking such as vacuum forming equipment and automatic packaging apparatus rendering the device inexpensive considering the volume encountered in this industry.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
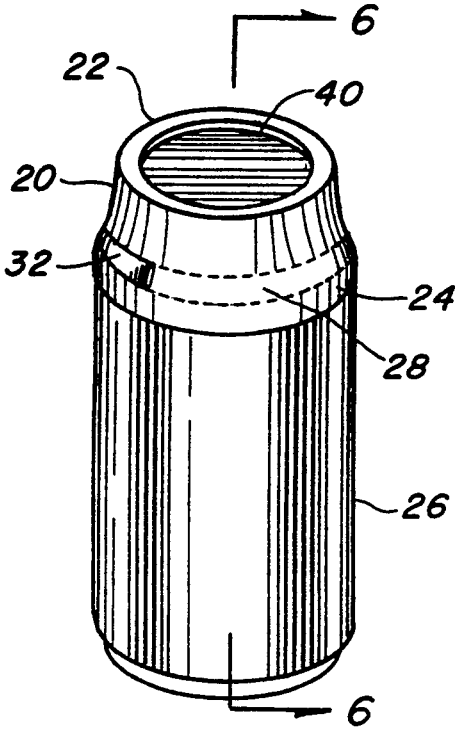
FIG. 1 is a partial isometric view of the preferred embodiment with the cover installed.

The best mode for carrying out the hygienic seal and cover for food and drink containers is presented in terms of a preferred embodiment, as shown in FIGS. 1 through 8. The cover is comprised of a cover body 20 having a lid 22 and downward depending peripheral sidewalls 24 that are illustrated best in FIGS. 1, 3-5. The cover body 20 encases the top and upper portion of a pull-tab metallic beverage can 26. The can 26 may be any of a variety of shapes and materials such as rolled bead flat top and bottom, to a deep drawn body with a rolled recessed top. The material of the can may be steel or aluminum either easily adapted to use the reclosable cover of the invention.

The cover body 20 is preferably formed of a thermoplastic material sufficiently pliable to hinge and grip the top of the can 26. The thickness of material may vary however, it has been found that 0.025 inch to 0.030 inch (0.64 to 0.76 mm) is optimum. The material may be any type suitable for the application such as polyethlene, polystryene, polyvinyl chloride, polycarbonate polyproplene, polyester and the like. The properties allowing the cover to hinge and grip the can are also a prerequisite of the formulation of each material.

Figure 8:
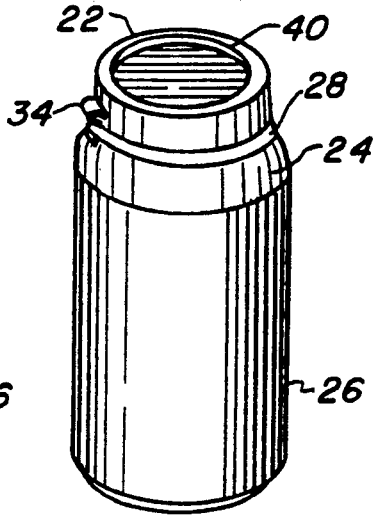
FIG. 8 is a partial isometric side view of the preferred embodiment with the tear strip completely removed and the lid resealed on the can.

The body 20 has an indentation in the form of a perforated tear strip 28 almost around the entire sidewall 24. This indentation allows the material to be torn from the parent structure of the cover 20 allowing a partial separation of the lid 22 from the sidewalls 24. As such, the lid 22 may now be raised permitting access to the pull-tab 30 and the contents of the can. The strip 28 may be completely removed from the cover 20, as shown in FIG. 8, or may be in an alternate embodiment, illustrated in FIG. 4, where the width of the strip 28 is enlarged on one end allowing the strip to remain with the can. The indentation of the tear strip 28 in the sidewall 24 is preferably from one eight to one quarter of the thickness of the body 20 enabling the strip to be easily removed by holding between one's fingers and pulling away from the can.

Further, this strip 28 formed from the indentations optionally contains starter means in the form of a protruding tab 32 raised sufficiently from the surface of the sidewall as to allow a person's fingernail to easily loosen the end permitting the strip to be grasped. This tab 32 is illustrated in one embodiment in FIG. 4 however, other shapes may be used with equal ease and utility.

Figure 2:
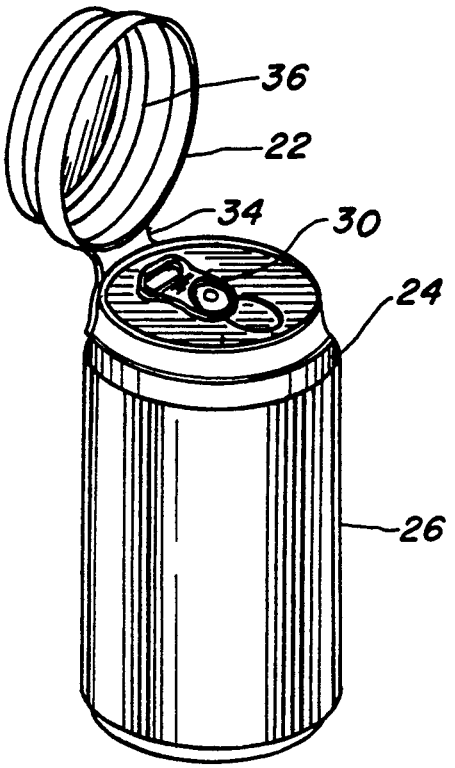
FIG. 2 is a partial isometric view of the preferred embodiment with the tear strip removed and the lid opened.
Figure 3:
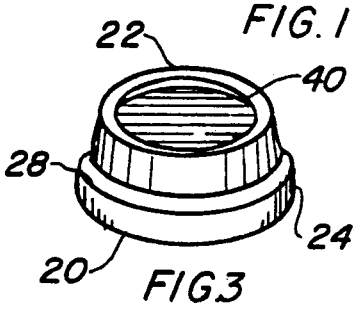
FIG. 3 is a partial isometric view of the preferred embodiment completely removed from the beverage can.
Figure 4:
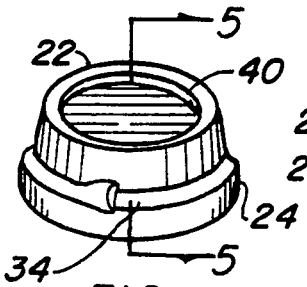
FIG. 4 is an isometric view of the rear of the cover removed from the beverage can.
Figure 5:
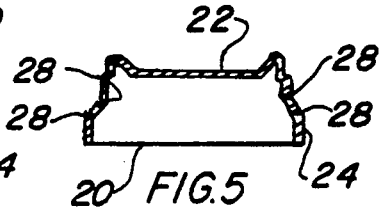
FIG. 5 is a cross sectional view taken along lines 5—5 of FIG. 4.
Figure 6:
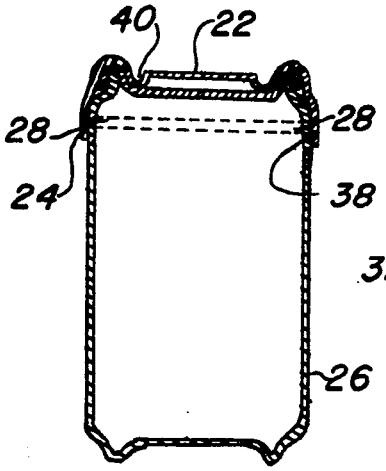
FIG. 6 is a cross sectional view taken along lines 6—6 of FIG. 1.
Figure 7:
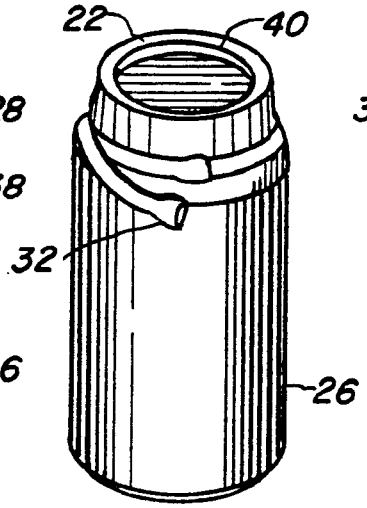
FIG. 7 is a partial isometric side view of the preferred embodiment with the tear strip partially removed.

The material remaining between the ends of the strip 64 become hinge means 34 permitting the lid 22 to be pivoted from the top of the can 26. The hinge 34 being pliable budges slightly from the surface as shown in FIG. 8 allowing the lid 22 to interface flush with the top of the can 26. This action compensates for the material removed from the tear strip 28 and may be pivoted repeatedly functioning as a, so called, living hinge. FIG. 2 illustrates the lid 22 in its upward position. Normally, the hinge has a tendency to close the lid on the can however, in use, it is easy and practical to simply hold the lid 22 away from the can with one's finger in a natural manner and the inclination to close is not undesirable as it partially protects the contents of the can everytime it is set down.

In order to maintain a seal between the lid 22 of the cover 20 and the top of the can 26 gripping means are utilized consisting of an inner lip 36 the same basic shape of the lid of the can 26 except slightly smaller, permitting a snap fit on the can sufficient to maintain a firm grip when the cover lid 22 is gently forced on the can. The fit of the inner lip 36 to the can 26 permits repeated sealings without permanent deformation or elongation.

The cover body 20 includes attaching means to join the sidewalls 24 to the beverage can 26. Any suitable method may be employed such as heat shrink by applying the cover at elevated temperatures and allowing the material to shrink as it cools making a tight and secure bond at a normal ambient temperature. Further, the thermoplastic material may be compounded to shrink when heat is applied and take a permanent set. Another method of attachment utilizes adhesive 36 placed between the inner surface of the sidwalls 24 and the can 26 preferably in a liquid state such that upon drying, a permanent bond is achieved. Another acceptable method is the addition of a coating of material attracted to both the can and cover body that upon hardening and curing holds the two surfaces together. The attachment method is not limited to those disclosed above as other means may be equally well employed as many methods of attachment are well known in the art.

Optionally, a stacking groove 40 may be formed integrally with the lid 22 in a mirror image of the bottom of the beverage can 26. This configuration permits a number of cans to be stacked one on top of the other adding to the utility of the invention.

As automatic machinery is normally involved, the method of producing this reclosable beverage can cover is important in automated production. The method involved includes the steps of: forming a cover body 20 including a lid 22 and sidewalls 24, forming an indentation strip 28 on the sidewall 24, leaving hinge means 34 in the body 20 adjacent to the strip 28, forming gripping means in the form of a inner lip 36 to interface with the can 26 and attaching the cover 20 to the can.

Indica may be added to the cover 20 for advertising purposes or characters may be formed into the base material of the cover during the manufacturing process if desired.

While the invention has been described in complete detail and pictorially shown in the accompanying drawings, it is not to be limited to such details since many changes and modifications may be made in the invention without departing from the spirit and the scope thereof. Hence, it is described to cover any and all modifications and forms which may come within the language and scope of the claims.

I claim:

1. A reclosable cover attached to a pull-tab metallic beverage can having an overlapped formed top comprising:

a) a cover body having a lid and a downwardly depending peripheral sidewall for encasing the top of the can to insure sterility prior to use, b) said body having a tearstrip formed by an indentation in and around the sidewall except for a portion of the periphery thereof, the tearstrip when removed substantially separating the lid from the sidewall of the body, c) hinge means between the lid and sidewall adjacent to said tearstrip permitting the lid to be pivoted from the can top when the tearstrip is removed for access to the can's pull-tab and subsequentially the can contents, d) gripping means integral with the cover body lid permitting the lid to snap over and contiguously grasp the can top when manually compressed thereon reclosing the cover to the can after use, and e) attaching means to join the sidewall of the cover body to the can for securement therebetween.

2. The cover as recited in claim 1 wherein said cover is formed of a pliable thermoplastic material for hinging about and gripping the can top.

3. The cover as recited in claim 1 wherein said tearstrip indentation in the body is from one eighth to one quarter of the thickness of the body enabling the tearstrip to be easily removed therefrom.

4. The cover as recited in claim 3 further comprising starter means slightly protruding from said cover body integrally formed with said tearstrip adjacent to said hinge means for instituting removal of the tearstrip from the cover body.

5. The cover as recited in claim 1 wherein said hinge means comprises a portion of the body between ends of the tearstrip which remains after said tearstrip has been removed, said hinge means having sufficient resiliency to bend without breaking.

6. The cover as recited in claim 1 wherein said gripping means further comprises an inner lip on said lid the same basic shape as the top of the can and slightly smaller in diameter thereby allowing a snap fit sufficient to grip the beverage can when the cover is resealed on the can after the tearstrip has been removed.

7. The cover as recited in claim 1 wherein said attaching means comprises heat shrink means for reducing the sidewall in diameter after the cover has been placed over the beverage can by the application of heat causing the cover to reduce in volume tightly gripping the can in a permanent manner.

8. The cover as recited in claim 1 wherein said attaching means comprises an adhesive positioned between the cover and the can in a liquid state that upon drying adheres the cover to the can in a permanent manner.

9. The cover as recited in claim 1 wherein said attaching means comprises a coating of material between the beverage can and the cover sidewall located where the downwardly depending peripheral sidewall terminates, thus forming an integral part of the cover and bonding to the can for making a permanent attachment when cured.

10. The cover as recited in claim 1 further comprising a stacking groove in the lid of the cover body in mirror image of the beverage can bottom permitting cans to be stacked one on top of the other for storage.

* * * * *